US011112222B2

(12) United States Patent
Coffey et al.

(10) Patent No.: US 11,112,222 B2
(45) Date of Patent: Sep. 7, 2021

(54) PROPELLANT WITH PATTERN-CONTROLLED BURN RATE

(71) Applicants: Spectre Materials Sciences, Inc., Melbourne, FL (US); University of Central Florida Research Foundation, Orlando, FL (US)

(72) Inventors: Kevin R. Coffey, Oviedo, FL (US); Timothy Mohler, Melbourne, FL (US); Daniel Yates, Melbourne, FL (US)

(73) Assignees: SPECTRE MATERIALS SCIENCES, INC., Melbourne, FL (US); UNIVERSITY OF CENTRAL FLORIDA RESEARCH FOUNDATION, INC., Orlando, FL (US)

( * ) Notice: Subject to any disclaimer, the term of this patent is extended or adjusted under 35 U.S.C. 154(b) by 0 days.

(21) Appl. No.: 16/748,068

(22) Filed: Jan. 21, 2020

(65) Prior Publication Data

US 2020/0232772 A1 Jul. 23, 2020

Related U.S. Application Data

(60) Provisional application No. 62/794,903, filed on Jan. 21, 2019, provisional application No. 62/847,276,
(Continued)

(51) Int. Cl.
*F42B 5/16* (2006.01)
*F42C 19/08* (2006.01)

(52) U.S. Cl.
CPC ..... *F42B 5/16* (2013.01); *F42C 19/0807* (2013.01)

(58) Field of Classification Search
CPC ..... F42B 5/16; F42C 19/0826; C06B 45/12; C06B 45/14
(Continued)

(56) References Cited

U.S. PATENT DOCUMENTS 2,131,352 A 9/1938 Marsh
2,239,123 A 4/1941 Stoneking
(Continued)

FOREIGN PATENT DOCUMENTS

GB 885409 A 12/1961
GB 987332 A 3/1965
GB 994184 A 6/1965

OTHER PUBLICATIONS

Jesse J. Sabatini, Amita V. Nagori, Gary Chen, Phillip Chu, Reddy Damavarapu, and Thomas M. Klapotke, High-Nitrogen-Based Pyrotechnics: Longer- and Brighter-Burning, Perchlo.
(Continued)

*Primary Examiner* — Bret Hayes
(74) *Attorney, Agent, or Firm* — William F. Lang, IV; Lang Patent Law LLC

(57) ABSTRACT

A propellant is made from a flexible sheet that in some examples is nitrocellulose. An ignitable material is deposited on one side of the flexible sheet. The ignitable material is a series of triangles having a base adjacent to one edge of the sheet, and an apex adjacent to the other side of the sheet. Some examples of the ignitable material may be thermite compositions. The flexible sheet is rolled around a nonburnable tube and placed within a firearm casing, with the triangle bases being adjacent to the back of the casing, and the triangle apexes being adjacent to the front of the casing. The nonburnable tube is disposed over the primer pocket, so
(Continued)

that ignition products from the primer travel through the tube, igniting the propellant adjacent to the front of the casing.

25 Claims, 10 Drawing Sheets

Related U.S. Application Data filed on May 13, 2019, provisional application No. 62/907,310, filed on Sep. 27, 2019.

(58) Field of Classification Search
USPC ..... 102/283, 284, 288, 289
See application file for complete search history.

(56) References Cited

U.S. PATENT DOCUMENTS 2,995,429 A 8/1961 Williams et al.
2,995,431 A 8/1961 Bice
3,122,884 A 3/1964 Grover et al.
3,155,749 A 11/1964 Rossen et al.
3,170,402 A 2/1965 Morton et al.
3,382,117 A 5/1968 Cook
3,668,872 A 6/1972 Camp et al.
3,711,344 A 1/1973 Pierce
3,715,248 A 2/1973 Swotinsky et al.
3,725,516 A 4/1973 Kaufman
3,808,061 A 4/1974 Pierce
3,896,731 A 7/1975 Kilmer
3,896,865 A 7/1975 Comfort et al.
3,905,846 A 9/1975 Berta
3,938,440 A 2/1976 Dooley et al.
3,956,890 A 5/1976 Davis
3,962,865 A * 6/1976 McCone, Jr. ..... F02K 9/14 60/255
3,995,559 A * 12/1976 Bice ..... C06B 45/12 102/284
4,013,743 A * 3/1977 Blasche, Jr. ..... C06B 21/0058 264/3.1
4,115,999 A 9/1978 Diebold
4,475,461 A 10/1984 Durrell
4,615,270 A * 10/1986 Bell ..... F42B 5/16 102/289
4,651,254 A 3/1987 Brede et al.
4,756,251 A 7/1988 Hightower, Jr. et al.
4,823,699 A * 4/1989 Farinacci ..... F42B 14/061 102/439
4,823,701 A 4/1989 Wilhelm
4,875,948 A 10/1989 Verneker
4,996,922 A 3/1991 Halcomb
5,076,868 A 12/1991 Doll et al.
5,080,017 A * 1/1992 Asikainen ..... F42B 30/10 102/285
5,237,927 A * 8/1993 Gonzalez ..... F42B 5/196 102/431
5,266,132 A 11/1993 Danen et al.
5,320,043 A 6/1994 Andre et al.
5,322,018 A * 6/1994 Hadden ..... C06B 33/06 102/284
5,363,768 A * 11/1994 Solberg ..... C06B 45/12 102/283
5,589,661 A 12/1996 Menke et al.
5,721,392 A * 2/1998 Chan ..... B60R 21/2644 102/275.1
5,773,748 A * 6/1998 Makowiecki ..... C06B 45/14 102/205
5,801,325 A 9/1998 Willer et al.
5,817,970 A 10/1998 Feierlein
5,854,439 A 12/1998 Almstrom et al.
6,158,348 A * 12/2000 Campoli ..... F42B 5/16 102/433
6,176,950 B1 1/2001 Wood et al.
6,183,569 B1 2/2001 Mohler
6,334,394 B1 1/2002 Zimmerman et al.
6,363,853 B1 4/2002 Rohr
6,364,975 B1 4/2002 Fleming et al.
6,599,379 B2 7/2003 Hiskey et al.
6,679,960 B2 1/2004 Jones
6,692,655 B1 2/2004 Martins et al.
6,712,917 B2 3/2004 Gash et al.
6,740,180 B1 5/2004 Cesaroni
6,805,832 B2 10/2004 Mohler et al.
6,843,868 B1 1/2005 Fawls et al.
6,962,112 B1 11/2005 Kern
7,770,380 B2 8/2010 Dulligan et al.
7,886,668 B2 2/2011 Hugus et al.
7,896,988 B2 3/2011 Mohler
7,918,163 B2 4/2011 Dahlberg
7,955,451 B2 6/2011 Hugus et al.
7,958,823 B2 6/2011 Sawka
7,998,290 B2 8/2011 Sheridan et al.
8,202,377 B2 6/2012 Erickson et al.
8,298,358 B1 8/2012 Coffey et al.
8,454,769 B2 6/2013 Erickson et al.
8,465,608 B1 6/2013 Coffey et al.
8,524,018 B2 9/2013 Busky et al.
8,544,387 B2 10/2013 Dahlberg
8,591,676 B2 11/2013 Coffey et al.
8,641,842 B2 2/2014 Hafner et al.
9,464,874 B1 10/2016 Mohler et al.
9,709,366 B1 7/2017 Mohler et al.
9,816,792 B1 11/2017 Mohler et al.
10,254,090 B1 4/2019 Mohler et al.
10,415,938 B2 9/2019 Mohler et al.
2006/0011276 A1 1/2006 Grix et al.
2006/0278119 A1 12/2006 Shilliday et al.
2007/0169862 A1 7/2007 Hugus et al.
2007/0272112 A1 11/2007 Nielson et al.
2008/0047453 A1 2/2008 Dahlberg
2008/0134924 A1 6/2008 Sawka
2009/0139422 A1 6/2009 Mohler
2010/0193093 A1 8/2010 Coffey et al.
2010/0282115 A1 11/2010 Sheridan et al.
2011/0067789 A1 3/2011 Grix et al.
2011/0259230 A1 10/2011 Sawka et al.
2011/0308416 A1 12/2011 Bar et al.
2012/0103479 A1 5/2012 Katzakian et al.
2012/0132096 A1 5/2012 Chin et al.
2013/0305950 A1 11/2013 Coffman, II

OTHER PUBLICATIONS

Marc Comet et al., Boron as Fuel for Ceramic Thermites (Abstract), Feb. 2014, https://pubs.acs.org/doi/10.1021/ef500221p.
Electroactive Polymers, Wikipedia, https://en.wikipedia.org/wiki/Electroactive_polymers, dated prior to the application filing date.

* cited by examiner

PROPELLANT WITH PATTERN-CONTROLLED BURN RATE

CROSS REFERENCE TO RELATED APPLICATION

This application claims the benefit of U.S. provisional patent application Ser. No. 62/794,903, which was filed on Jan. 21, 2019, and entitled "Thin Film Propellant." This application also claims the benefit of U.S. provisional patent application Ser. No. 62/847,276, which was filed on May 13, 2019, and entitled "Thin Film Propellant." This application further claims the benefit of U.S. provisional patent application Ser. No. 62/907,310, which was filed on Sep. 27, 2019, and entitled "Thin Film Propellant."

TECHNICAL FIELD

The present invention relates to propellants for firearms, other guns such as artillery pieces, missiles, torpedoes, and the like.

BACKGROUND INFORMATION

Propellants are commonly utilized to propel projectiles in a desired direction. Propellants typically burn to produce a gas. Increasing gas pressure serves to propel the projectile. In the case of firearms, a common propellant is smokeless powder, which may take the form of a single base, double base, or triple base powder (or more correctly, granular material). Single base powder comprises nitrocellulose. Double base powder utilizes nitrocellulose and nitroglycerin. Triple base powder utilizes nitrocellulose, nitroglycerin, and nitroguanidine. Various stabilizers may also be added to the gunpowder. The rate at which each of these powders burns is controlled in part by controlling the size of the granules. However, the resulting gas pressure typically reaches its maximum very quickly, and then rapidly decreases. Since pressure is decreasing while a projectile is still within the barrel of a gun, some opportunity to increase the velocity of the projectile is lost.

Energetic materials such as thermite are presently used when highly exothermic reactions are needed. Uses include cutting, welding, purification of metal ores, and enhancing the effects of high explosives. A thermite reaction occurs between a metal oxide and a reducing metal. Examples of metal oxides include $La_2O_3$, AgO, $ThO_2$, SrO, $ZrO_2$, $UO_2$, BaO, $CeO_2$, $B_2O_3$, $SiO_2$, $V_2O_5$, $Ta_2O_5$, NiO, $Ni_2O_3$, $Cr_2O_3$, $MoO_3$, $P_2O_5$, $SnO_2$, $WO_2$, $WO_3$, $Fe_3O_4$, COO, $Co_3O_4$, $Sb_2O_3$, PbO, $Fe_2O_3$, $Bi_2O_3$, $MnO_2$, $Cu_2O$, and CuO. Example reducing metals include Al, Zr, Th, Ca, Mg, U, B, Ce, Be, Ti, Ta, Hf, and La. The reducing metal may also be in the form of an alloy or intermetallic compound of the above-listed metals.

An example of a present propellant is U.S. Pat. No. 7,918,163, issued to J. Dahlberg on Oct. 1, 2013. This patent discloses a progressive propellant charge. This patent discloses nested cylindrical propellant sections, with each section having a different burn rate. Ignition starts in the innermost cylindrical section, having the slowest burn rate, and progresses outward, with successive outward sections having faster burn rates. U.S. Pat. No. 8,544,387 includes the same disclosure.

U.S. Pat. No. 6,692,655, which discloses a method of making a multi-base propellant from pellet size nitrocellulose. The method begins with nitrocellulose. The nitrocellulose is diluted in a non-solvent to form a slurry. A liquid elastomer precursor polymer is added in order to improve the mechanical properties at high and low temperatures. A thermal stabilizer is also added. The non-solvent is then removed from a slurry by heating. Plasticizers are added to the coated pellets, which in some cases may be energetic plasticizers. If a triple base propellant is desired, energetic solids are used in combination with the nitrocellulose and plasticizers. If a multi-base propellant is desired, then oxidizer particles and inorganic fuel particles can also be included. Oxidizers include ammonium perchlorate, ammonium nitrate, hydroxylammonium nitrate, ammonium dinitramide, potassium dinitramide, potassium perchlorate, or mixtures of the above. Fuels include aluminum, magnesium, boron, titanium, silicon, and mixtures thereof.

U.S. Pat. No. 8,454,769 discloses a non-toxic percussion primer. Magnesium is used as one possible fuel particle for the primary explosive, and an oxide coating on the Magnesium is preferred to reduce its sensitivity and reduce the need for an additional protective coating. Nitrocellulose is used as a secondary explosive. A dual acid buffer is used to reduce temperature induced onset of hydrolysis. The priming compound also includes tetracene as a sensitizer and glass powder as a friction generator. Oxidizers in the form of moderately active metal oxides are also included.

U.S. Pat. No. 8,202,377 discloses non-toxic percussion primers. This patent is very similar to the previously discussed patent.

U.S. Pat. No. 3,808,061 discloses a nitrocellulose solid propellant composition with a load additive to reduce radar attenuation. The propellant utilizes nitrocellulose with an energizing plasticizer that may be a nitrate ester such as nitroglycerin. A metallic fuel such as aluminum, boron, or magnesium may also be included. Alternatively, a nonexplosive plasticizer may be used. A stabilizer is also included. Powdered lead chromate is included in order to reduce the radar attenuation of the propellant.

U.S. Pat. No. 3,956,890 discloses a composite modified double base propellant with a metal oxide stabilizer. The metal may be magnesium, aluminum, tin, lead, titanium, or zirconium. Nitrocellulose or plasticized nitrocellulose is used as the binder. Nitroglycerin, triethyleneglycol dinitrate, and other plasticizers are disclosed as being known in the art.

U.S. Pat. No. 3,711,344 discloses the processing of cross-linked nitrocellulose propellants. The propellant may include a plasticizer, a stabilizer, a cross-linker, a metal fuel, and an organic or inorganic oxidizer. The metal fuel can be aluminum, zirconium, boron, beryllium, or magnesium.

U.S. Pat. No. 8,641,842 discloses a propellant composition including stabilized red phosphorus. The propellant composition is claimed to have a reduced peak pressure, but higher average pressure as compared to other propellants. The red phosphorus is coated with a metal oxide in order to stabilize the red phosphorus, and to resist reactions with oxygen or water. The stabilized red phosphorus is then coated with a polymer such as a thermoset resin. The propellant further includes an energetic binder such as nitrocellulose, and an energetic plasticizer such as nitroglycerin. A carbon compound such as graphite may be included. The propellant may include at least one oxidizer which may be a nitrate compound, and at least one inorganic fuel such as a metal or metal oxide compound. Magnesium is one example of the inorganic fuel. Potassium sulfate may be included as a flash suppressor. A similar composition is disclosed in US 2014/0137996.

U.S. Pat. No. 6,599,379 discloses low smoke nitroglycerin and nitrocellulose-based pyrotechnic compositions. The composition includes an oxidizing agent. Ammonium perchlorate is the preferred oxidizer. Metal salts are added as flame coloring agents. Magnesium or other metal flakes or powders can be added to increase the temperature or light output for to produce a spark effects.

U.S. Pat. No. 3,905,846 discloses a composite modified double base propellant with metal oxide stabilizer. The propellant includes a binder of nitrocellulose and a plasticizer such as nitroglycerin. An oxidizer such as a perchlorate or nitrate is included. Ammonium perchlorate is the most preferred. The propellant includes a metal fuel such as aluminum, zirconium, lithium, or magnesium. Aluminum is the most preferred. An oxide of a metal from the group consisting of cadmium, magnesium, aluminum, tin, lead, titanium, or zirconium is included as a stabilizer.

U.S. Pat. No. 3,896,865 discloses a propellant with polymer containing nitramine moiettes as a binder. The use of magnesium and other metal fuels is also disclosed.

U.S. Pat. No. 3,715,248 discloses a castable metallic illuminant containing a fuel and oxidizer as well as a nitrocellulose plasticized binder. The metallic fuel is either magnesium or aluminum. The oxidizer is sodium or potassium nitrate.

U.S. Pat. No. 3,668,872 discloses a solid propellant rocket. The powdered fuel is selected from beryllium, boron, aluminum, magnesium, zirconium, titanium, lithium, silicon, aluminum borohydride, and the hydrides of any of these metals. Nitrocellulose is one of several possible binders. This fuel is contained within a pressure chamber within the rocket. A toroidal tank is arranged externally of the nozzle, and contains an alkane, alkene, or alkyne fuel. The fuel from the tank is injected into the expansion nozzle to mix with the combustion products.

U.S. Pat. No. 3,382,117 discloses a thickened aqueous explosive composition containing entrapped gas. The sensitizer may be TNT or a single base, double base (combination of nitroglycerin and nitrocellulose, or triple base smokeless powder. A triple base powder may include aluminum or other heat producing metals such as magnesium.

U.S. Pat. No. 2,131,352 discloses a propellant explosive. Powdered aluminum and magnesium are suggested for addition to smokeless powder for the purpose of speeding up the combustion of the smokeless powder.

U.S. Pat. No. 3,275,250 discloses a process for making fine particles of nitrocellulose. The process includes ball milling the nitrocellulose in either water or organic nonsolvent slurry. Fine sand is then used for light grinding and dispersing. Next, nitrocellulose is separated from the sand by screening.

GB 885,409 discloses fuel grains for rocket engines. The fuel is in the form of a consumable honeycomb structure, with a honeycomb material being inorganic sheet material such as polyethylene, polyurethane, polypropylene, or synthetic rubber which may or may not contain granular fuel fillers or additives such as powdered aluminum, lithium, boron, magnesium, or sodium. Alternatively, the honeycomb structure can be made from metal foils such as aluminum, magnesium, or lithium. The cell openings may be packed with oxidizer such as ammonium nitrate or sodium, potassium, lithium, or ammonium perchlorate.

Jesse J. Sabatini, Amita V. Nagori, Gary Chen, Phillip Chu, Reddy Damavarapu, and Thomas M. Klapotke, High-Nitrogen-Based Pyrotechnics: Longer- and Brighter-Burning, Perchlorate Free, Red-Light Illuminants for Military and Civilian Applications (2011) discloses a formula including 39.3% strontium nitrate, 29.4% to 35.4% magnesium, 14.7% PVC, and other minor ingredients.

U.S. Pat. No. 5,076,868 discloses a solid propellant composition producing halogen free exhaust. The propellant utilizes magnesium as a fuel and ammonium nitrate as an oxidizer. Hydroxy terminated polybutadiene (HTPB) is one possible binder. Polypropylene glycol is the preferred binder. Ammonium nitrate is provided at 40% to 70% by weight, magnesium is 16% to 36% by weight, and PPG is 10% to 25% by weight, with 12 to 18% by weight being preferred.

U.S. Pat. No. 5,320,043 discloses a low vulnerability explosive munitions element including a multi-composition explosive charge. The explosive includes an organic nitrate explosive within a polyurethane or polyester polymer matrix, with the organic nitrate explosive being about 20% by weight. A peripheral layer also utilizes a polyurethane or polyester polymer matrix containing an organic nitrate explosive, but at less than 17% by weight, and also containing a mineral oxidant. The peripheral layer may contain a reducing metal such as aluminum, zirconium, magnesium, boron, and their mixtures. A mineral oxidant such as ammonium perchlorate, potassium perchlorate, ammonium nitrate, sodium nitrate, and their mixtures may also be included.

U.S. Pat. No. 6,176,950 discloses an ammonium nitrate and paraffinic material based gas generating propellants. Ammonium nitrate is included as an oxidizer, and the paraffinic material is the fuel. Examples include paraffin wax, as well as polyolefins such as polyethylene, polypropylene, and polybutylene. Small quantities of magnesium stearate, potassium perchlorate, or RDX may also be included. The content is ignited by a crash sensor which closes an electrical circuit, igniting a small explosive charge that produces a heat flash sufficient to ignite the gas producing composition. One example includes 93% by weight ammonium nitrate, 6%. 5 paraffin wax, and 1% magnesium stearate. Other examples include 88% ammonium nitrate, 6% purified paraffin wax, 5% potassium perchlorate, and 1% magnesium stearate. The claims include specific percentages of each ingredient.

U.S. Pat. No. 5,801,325 discloses solid propellants for launch vehicles. The propellant is based on a polygycidyl nitrate elastomer binder, ammonium nitrate oxidizer, and aluminum or magnesium fuel. Nitroglycerin and nitrocellulose are both criticized as energetic binders. However, nitroglycerin is listed as a suitable plasticizer.

U.S. Pat. No. 3,155,749 discloses an extrusion process for making propellant grains. The process is adapted for casting and molding composite, polyvinyl chloride, plastisol propellants, such as propellants in which the polymeric fuel binder is polyvinyl chloride or a copolymer of vinyl chloride and vinyl acetate, in which the vinyl chloride is in major proportion. Organic plasticizers used with the propellants include butyl, octyl, glycol, and methoxy-methyl esters of phthalic, adipic, and sebacic acids, high molecular weight fatty acid esters, and the like. Metal powders can be suspended within the fuel, including Al, Mg, Be, Ti, and Si.

U.S. Pat. No. 2,995,429 discloses a solid composite rubber base ammonium nitrate propellant cured with metal oxide. The propellant is intended for use as a rocket fuel, and includes an oxidant such as ammonium nitrate, a burning rates catalyst such is Milori blue, and a copolymer of the conjugated diene and a heterocyclic nitrogen base that can be cured into a solid rocket fuel grain by the addition of zinc oxide or magnesium oxide. A reinforcing agent such as carbon black can also be included. Sodium nitrate is one of many other alternative oxidants.

U.S. Pat. No. 5,589,661 discloses a solid propellant based on phase stabilized ammonium nitrate. The ammonium nitrate is 35% to 80% of the propellant by weight, and is phase stabilized by chemical reaction with either copper oxide or zinc oxide. A binder polymer is 15% to 50% of the propellant by weight, and an energy rich plasticizer, as well as 0.2% to 5% burn moderator of the vanadium/molybdenum oxide as an oxide mixture and mixed oxide. The propellant may include 0.5% to 20% by weight metals such as aluminum, magnesium, or boron. The binder polymer can be inert. The energy rich plasticizers are chemically stable nitrate esters, nitro, nitroamino, or as azido plasticizers.

GB 987,332 discloses a propellant composition. The propellant is a polyvinyl chloride propellant having a solid oxidizer homogenously dispensed therethrough. The oxidizer can include ammonium perchlorate, sodium perchlorate, potassium perchlorate, sodium nitrate, or ammonium nitrate. Finely divided aluminum or magnesium is included within the propellant in a minor proportion by weight. The aluminum or magnesium has been found to increase the specific impulse and burning rate, while reducing the pressure exponent. Magnesium also results in reduced corrosion properties. About two parts polyvinyl chloride to three parts plasticizer, or a 1:1 ratio of these components, are used within the propellant. The oxidizer is about 75% by weight. About 5% to 16% of the propellant will be aluminum or magnesium.

U.S. Pat. No. 2,995,431 discloses a composite of ammonium nitrate propellant containing boron. The composite includes, out of 100 parts total composition, from 3.5 to 8 parts of the binder component that is a rubbery polymer, from 86 to 94 parts and ammonium nitrate oxidizer, from 0 to 5 parts a burning rates catalyst, and from 1 to 10 parts a finely divided high-energy additive of magnesium, mixture of boron and magnesium, or boron, or mixtures consisting of at least 50 weight percent of at least one of the above three ingredients with another finally divided metal of aluminum, beryllium, and lithium, or a mixture thereof. The high-energy additive preferably has a particle size of less than 50μ, with 20μ or even 10μ being preferred. The rubbery polymer includes polymers of olefins and diolefins such as polybutadiene, polyisobutylene, polyisoprene, copolymers of isobutylene and isoprene, copolymers of conjugated dienes and comonomers such as styrene, and copolymers of conjugated dienes and polymerizable heterocyclic nitrogen bases.

U.S. Pat. No. 3,725,516 discloses a mixing and extrusion process for solid propellants. The propellant is made from a copolymer of vinylidine fluoride and perfluoropropylene, an inorganic oxidizer such as ammonium perchlorate, potassium perchlorate, or ammonium nitrate, and a metal powders such as aluminum, beryllium, magnesium, or zirconium. The fluorocarbon binder is in the range of from 10% to 35% of the composition. The metal fuel is in the range from about 5% to 70% of the composition, and the oxidizer is in a range from about 25% to 75% of the composition. The ingredients are mixed with a solvent such as acetone with rapid stirring, and then air dried or oven dried before being compression molded or extruded into the desired shape.

U.S. Pat. No. 8,524,018 discloses a percussion primer composition. The composition includes a stabilized, encapsulated red phosphorus, an oxidizer, a secondary explosive composition, a light metal, and an acid resistant binder. The polymer layer may be epoxy resin, melamine resin, phenyl formaldehyde resin, polyurethane resin, or a mixture thereof. The oxidizer may be a light metal nitrate. The light metal (not part of the oxidizer) may include magnesium, aluminum, or a mixture thereof. The acid resistant binder may be polyester, polyurethane, or others.

U.S. Pat. No. 4,115,999 discloses the use of a high-energy propellants in gas generators. The propellant is 14% by weight carboxy terminated polybutadiene, 69% by weight ammonium perchlorate, and 17% by weight aluminum. Ammonium nitrate is listed as an alternative oxidizer. Nitroglycerin and nitrocellulose are listed as possible binders.

U.S. Pat. No. 6,364,975 is representative of a group of patents issued to W. C. Fleming et al. and assigned to Universal Propulsion Co., Inc. This patent discloses an ammonium nitrate propellant. The gas producing embodiments of the propellant are designed to be used in vehicle airbag restraint systems wherein gas production is paramount. The propulsive embodiments of the propellant are designed to be used in rockets and other munitions wherein energy output is paramount. The ammonium nitrate propellant includes a molecular sieve such as an aluminosilicate type molecular sieve. The molecular sieve is present from about 0.02% to about 6% by weight. Binders such as plastic elastomers and cure hardening materials may be included. Polyglycol adipate is the preferred binder. An energetic additive such as nice of nitroglycerin may be included. The energetic plasticizer is typically included in an amount from about 5% to about 40% by weight. Similar propellants are disclosed in U.S. Pat. Nos. 5,583,315, 6,059,906, 6,726,788, 6,913,661, and CA 2,273,335.

GB 994,184 discloses improvements in or relating to propellant grains. Metallic heat conductors are embedded within the propellants. The heat conductors effect rapid heat transfer from the combustion gases to the unburned propellant, resulting in more rapid burning than would be possible with heat transfer through the propellant itself. One propellant disclosed therein includes 12.44% polyvinyl chloride, 12.44% dibutyl sebacate, 74.63% ammonium perchlorate, and a 0.49% state stabilizer. Aluminum and magnesium can be used as the conductor.

U.S. Pat. No. 3,122,884 discloses a rocket motor. The engine uses a semisolid monopropellant, for example, nitroglycerin gelled to a semisolid consistency by solution of nitrocellulose. A liquid fuel can be any oxidizable liquid. A solid oxidizer is also utilized. Metal powders such as aluminum or magnesium can be incorporated into the monopropellant.

U.S. Pat. No. 3,794,535 discloses a pyrotechnic lacquer. The lacquer is a dispersion of a pyrotechnic composition in a colloidion. The pyrotechnic composition can be aluminum thermal powders, thermite powders, black powder, or powders based on zirconium, barium, chromate, ammonium perchlorate, or ammonium bichromate. The collodion contains either a powder based on nitrocellulose, on plasticized nitrocellulose, or on a mixture of nitrocellulose and nitroglycerin, dissolved in a volatile solvent such as ketone solvents, acetone, or methyl ethyl ketone, or a plastics material dissolved in an organic solvent, such as polyethylene dissolved in trichloroethylene, polyvinyl chloride dissolved in methyl ethyl ketone, or a cellulosic polymer disclosed in ethyl acetate. The lacquer is especially useful as an ignition composition for blocks of solid propellant.

SUMMARY

The above needs are met by a propellant. The propellant comprises a flexible sheet defining a first surface, a first edge, and a second edge. The flexible sheet has an ignitable material deposited thereon. The ignitable material is deposited in a pattern, with the pattern defining at least one covered sheet portion upon which ignitable material has been deposited and at least one uncovered sheet portion upon which ignitable material is not present. The covered and uncovered sheet portions are predetermined to provide a predetermined ignition rate or a predetermined pressure curve within a pressure vessel.

The above needs are further met by a firearm cartridge. The firearm cartridge comprises a casing, with the casing having a side wall, an interior portion within the side wall, an open front end, a back end, a primer pocket defined within the back end, and a flash hole defined between the primer pocket and the interior portion. The cartridge further includes a propellant. The propellant comprises a flexible sheet defining a first surface, a first edge, and a second edge. The flexible sheet has an ignitable material deposited thereon. The ignitable material is deposited in a pattern, with the pattern defining at least one covered sheet portion upon which ignitable material has been deposited and at least one uncovered sheet portion upon which ignitable material is not present. The covered and uncovered sheet portions are predetermined to provide a predetermined ignition rate or a predetermined pressure curve within a pressure vessel.

The cartridge further comprises a nonburnable tube defining a pair of ends and a passageway therebetween. The flexible sheet is rolled around the nonburnable tube. The propellant is disposed within the interior portion of the casing, with the first edge of the flexible sheet being adjacent to the back end of the casing, the second edge of the flexible sheet being adjacent to the front end of the casing. One end of the nonburnable tube is disposed over the flash hole, with the flash hole being in communication with the passageway.

These and other aspects of the invention will become more apparent from the following description and drawings.

BRIEF DESCRIPTION OF THE DRAWINGS

Like reference characters denote like elements throughout the drawings.

DETAILED DESCRIPTION

Figure 1:
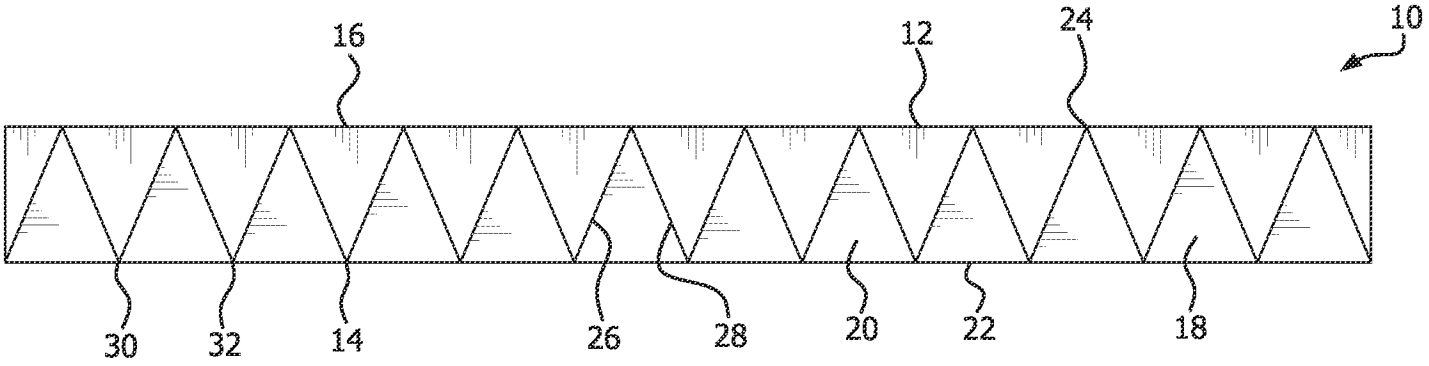
FIG. 1 is a top plan view of a propellant sheet, showing the sheet unrolled.

Referring to the drawings, a thin film propellant is illustrated. In general, the propellant includes a burnable or explosive substrate having a material or combination of materials having a high burn rate deposited thereon in a deposition pattern that provides a predetermined effect on the burn rate of the substrate.

Figure 2:
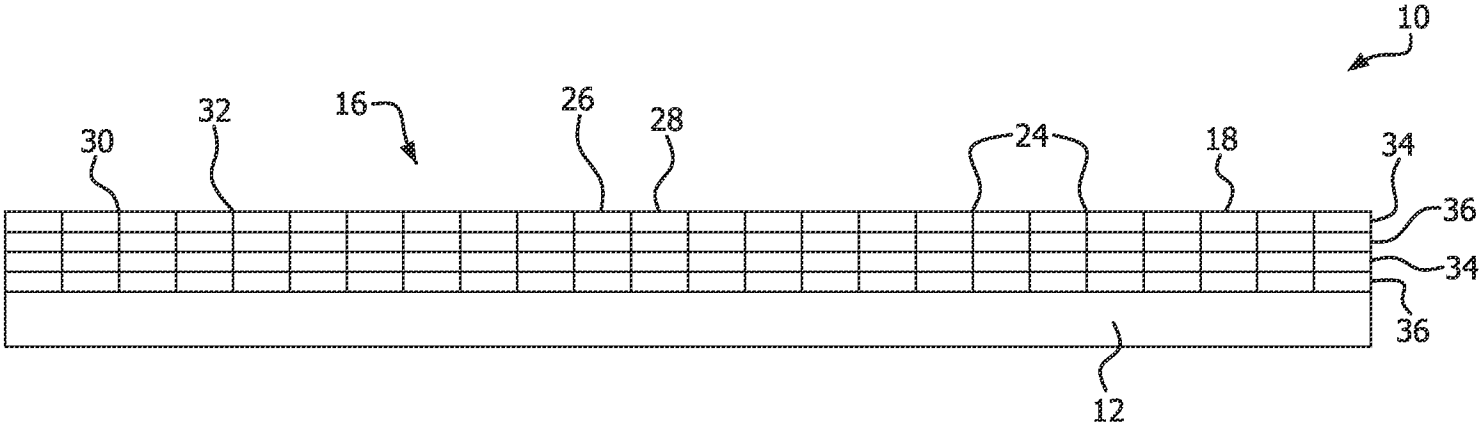
FIG. 2 is a side elevational view of a propellant sheet of FIG. 1, showing the sheet unrolled.
Figures 3, 4:
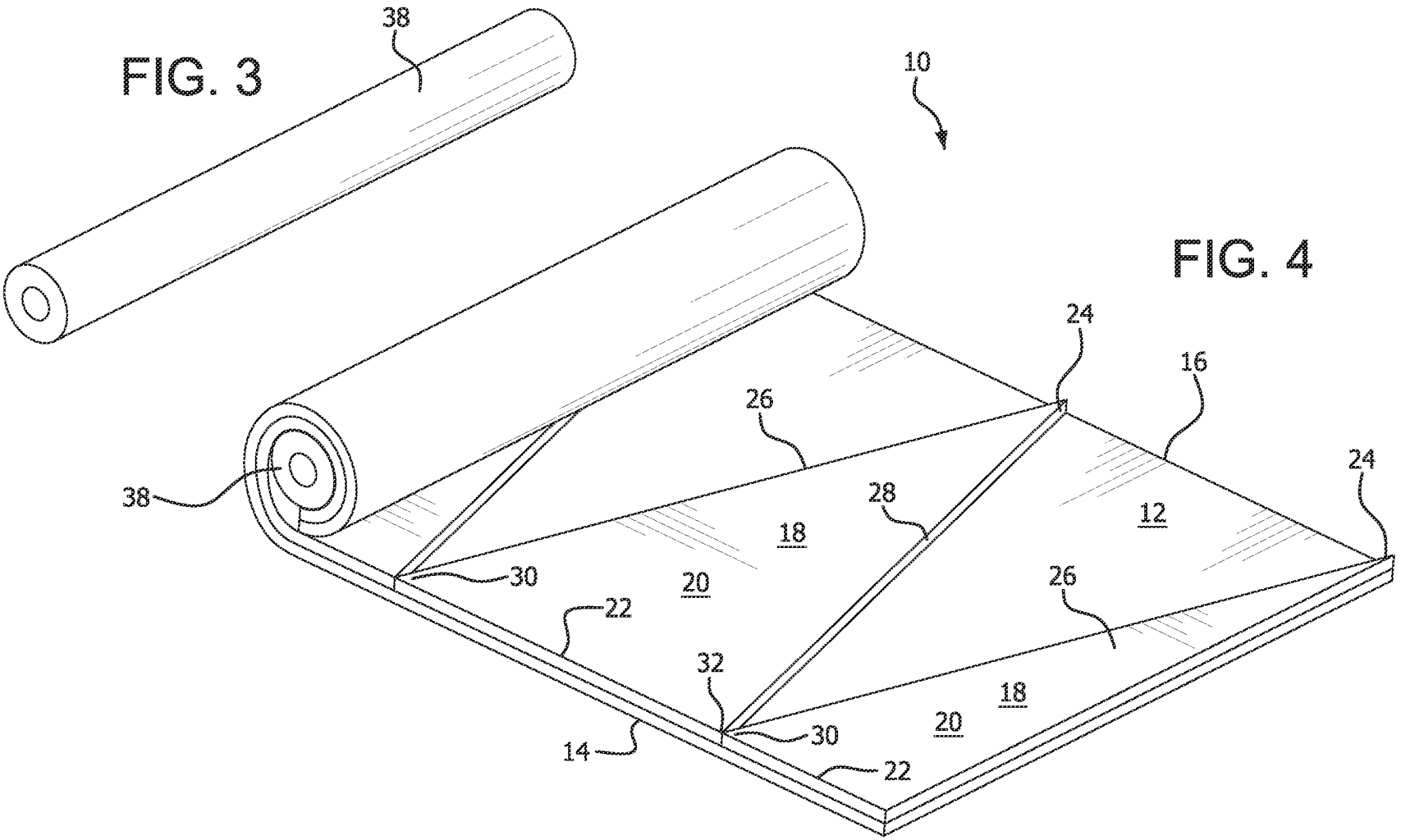
FIG. 3 is a perspective view of a nonburnable tube for use within the propellant sheet of FIG. 1.
FIG. 4 is a perspective view of a propellant sheet of FIG. 1 partially rolled around a nonburnable tube of FIG. 3.

Referring to FIGS. 1, 2, and 4, the propellant 10 includes a substrate sheet 12, which in an illustrated example is made from either nitrocellulose (single base smokeless powder), or from a combination of nitrocellulose and nitroglycerin (double base smokeless powder). Other examples of the sheet 12 can be made from combinations of a polymer and a burnable metal such as any of the reducing metals utilized in thermite combinations, with the polymer serving as a source of oxygen for combustion of the burnable metal. One example includes a combination of at least one aluminum layer and at least one layer of a dielectric polymer Additional examples of the sheet 12 can be made from explosive material such as high explosive material. Still other examples of the sheet 12 can be made from one or both reaction components of an intermetallic reaction pair, for example, boron and/or titanium. Further examples of the sheet 12 can be made from at least one layer of a dielectric polymer, at least one layer of aluminum, and at least one layer of boron.

The sheet 12 includes a first edge 14 and a second edge 16. A burnable material 18 having a high burn rate has been deposited upon one side of the substrate sheet 12. In the illustrated example, the high burn rate burnable material is a thermite composition 18. Other examples of the sheet 12 can be made from combinations of a polymer and a burnable metal such as any of the reducing metals utilized in thermite combinations, with the polymer serving as a source of oxygen for combustion of the burnable metal. Still other examples of the sheet 12 can be made from one or both reaction components of an intermetallic reaction pair, for example, boron and/or titanium.

The thermite composition 18 or other high burn rate material is deposited in a pattern that is designed to produce a desired burn rate, resulting in a desired pressure curve. In the illustrated example, the thermite composition 18 has been deposited in a series of triangles 20, with each triangle having a base 22 adjacent to the first edge 14, and an apex 24 adjacent to the second edge 16. The illustrated triangles are isosceles triangles, each of which has substantially equal sides 26, 28. However, other types of triangles, for example, right triangles having one edge perpendicular to the edges 14, 16, could be used without departing from the scope of the invention. Additionally, although the base 22 and sides 26, 28 are illustrated as substantially straight, other configurations can be used without departing from the scope of the invention. It is also not necessary for the apex 24 to be a perfect point, or for any of the other corners 30, 32 to be perfect points. The critical feature is that, as ignition propagates from the edge 16 to the edge 14, the portion of the sheet 12 covered by the thermite composition 18 or other high burn rate material corresponds to a desired burn rate and pressure curve at that point in the ignition process.

Referring to FIG. 2, one example of a layered thermite coating 14 includes alternating layers of metal oxide 34 and reducing metal 36 (with only a small number of layers illustrated for clarity). Examples of metal oxides 34 include $La_2O_3$, AgO, $ThO_2$, SrO, $ZrO_2$, $UO_2$, BaO, $CeO_2$, $B_2O_3$, $SiO_2$, $V_2O_5$, $Ta_2O_5$, NiO, $Ni_2O_3$, $Cr_2O_3$, $MoO_3$, $P_2O_5$, $SnO_2$, $WO_2$, $WO_3$, $Fe_3O_4$, CoO, $Co_3O_4$, $Sb_2O_3$, PbO, $Fe_2O_3$, $Bi_2O_3$, $MnO_2$, $Cu_2O$, and CuO. Example reducing metals 36 include Al, Zr, Th, Ca, Mg, U, B, Ce, Be, Ti, Ta, Hf, and La. If the propellant 10 is used within a firearm, then the metal oxide 34 and reducing metal 36 are preferably selected to resist abrasion or other damage to a barrel of a firearm with which a cartridge containing the primer is used by avoiding reaction products which could potentially cause such damage. A preferred combination of metal oxide 34 and reducing metal 36 is cupric oxide (CuO) and magnesium.

The thickness of each metal oxide layer 34 and reducing metal layer 36 are determined to ensure that the proportions of metal oxide 34 and reducing metal 36 are such so that both will be substantially consumed by the exothermic reaction. As one example, in the case of a metal oxide layer 34 made from CuO and reducing metal layer 36 made from Mg, the chemical reaction is $CuO+Mg \rightarrow Cu+MgO+heat$. The reaction therefore requires one mole of CuO, weighing 79.5454 grams/mole, for every one mole of Mg, weighing 24.305 grams/mole. CuO has a density of 6.315 g/cm$^3$, and magnesium has a density of 1.74 g/cm$^3$. Therefore, the volume of CuO required for every mole is 12.596 cm$^3$. Similarly, the volume of Mg required for every mole is 13.968 cm$^3$. Therefore, within the illustrated example, each layer of metal oxide 34 is about the same thickness or slightly thinner than the corresponding layer of reducing metal 36. If other metal oxides and reducing metals are selected, then the relative thickness of the metal oxide 34 and reducing metal 36 can be similarly determined. If a burnable metal and a polymer are used, the amount of burnable metal and polymer can be determined by following the above example. If an intermetallic reaction pair is used, the amount of each reaction pair component metal can also be determined as illustrated above.

In addition, the reaction between magnesium 36 and nitrocellulose 12 can be used to produce energy. The reaction between magnesium and nitrocellulose is $3Mg+2C_6H_{10}O_{10}N_3 \rightarrow 3MgO+6H_2O+3N_2+12CO$. With this in mind, excess magnesium can be included for this reaction. Thus, in addition to the thickness of the magnesium layers 36 as described above, extra magnesium can be provided, so that the extra magnesium is equal to about one eighth of the amount of nitrocellulose 12 that is present.

Layers 34 and 36 are between about 20 nm and about 100 nm thick in the illustrated example, although other thicknesses can be used without departing from the scope of the invention. The total thickness of the illustrated examples of the layered thermite coating 18 is between about 25 μm and about 1,000 μm, although other thicknesses can be used without departing from the scope of the invention.

A layered thermite coating 18 can be made by sputtering or physical vapor deposition. In particular, high power impulse magnetron sputtering can rapidly produce the thermite coating 18. As another option, specific manufacturing methods described in U.S. Pat. No. 8,298,358, issued to Kevin R. Coffey et al. on Oct. 30, 2012, and U.S. Pat. No. 8,465,608, issued to Kevin R. Coffey et al. on Jun. 18, 2013, are suited to depositing the alternating metal oxide and reducing metal layers in a manner that resists the formation of oxides between the alternating layers, and the entire disclosure of both patents is expressly incorporated herein by reference. Dr. Coffey's methods permit the interface between alternating metal oxide and reducing metal layers to be either substantially free of metal oxide, or if reducing metal oxides are present, then the reducing metal oxide layer forming the interface will have a thickness of less than about 2 nm., or in some examples less than about 1 nm. Lithography can be used to remove undesired portions of the thermite layer, and in the illustrated example results in the triangles of exposed nitrocellulose.

Figure 5:
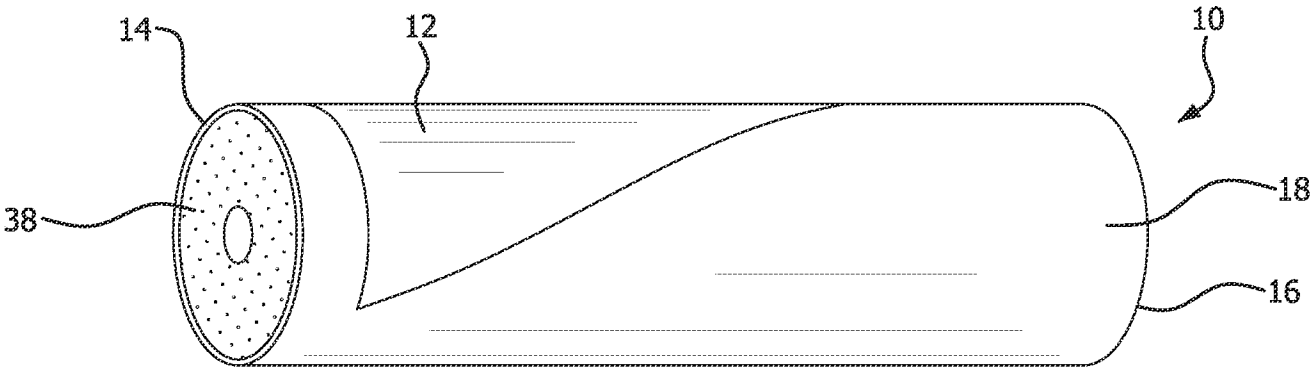
FIG. 5 is a perspective view of a propellant sheet of FIG. 1 completely rolled around a nonburnable tube of FIG. 3.
Figure 6:
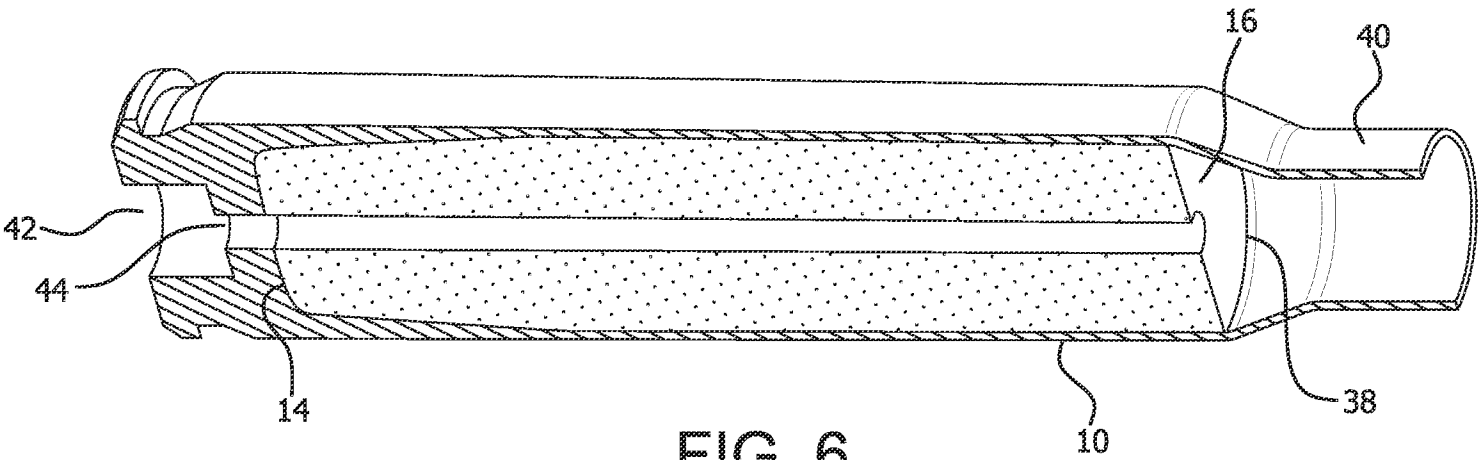
FIG. 6 is a perspective view of a cartridge casing containing the rolled propellant sheet of FIG. 5.

As shown in FIGS. 3-5, once the thermite 18 or other high burn rate material is deposited, the sheet 12 can be rolled around a tube 38 made from a nonburnable material, for example, brass. The rolled sheet 12 and tube 38 are then inserted into a cartridge casing 40 (FIG. 6) with the edge 14 closest to the primer pocket 42, and with the nonburnable tube 38 being disposed over the flash hole 44 through which combustion products from the primer pass into the interior of the casing 40. Upon ignition of the primer, the ignition products are propelled through the nonburnable tube 38 to the edge 16 of the sheet 12. The propellant 10 thus begins ignition at the edge 16, burning towards the edge 14 as ignition progresses.

Figure 7:
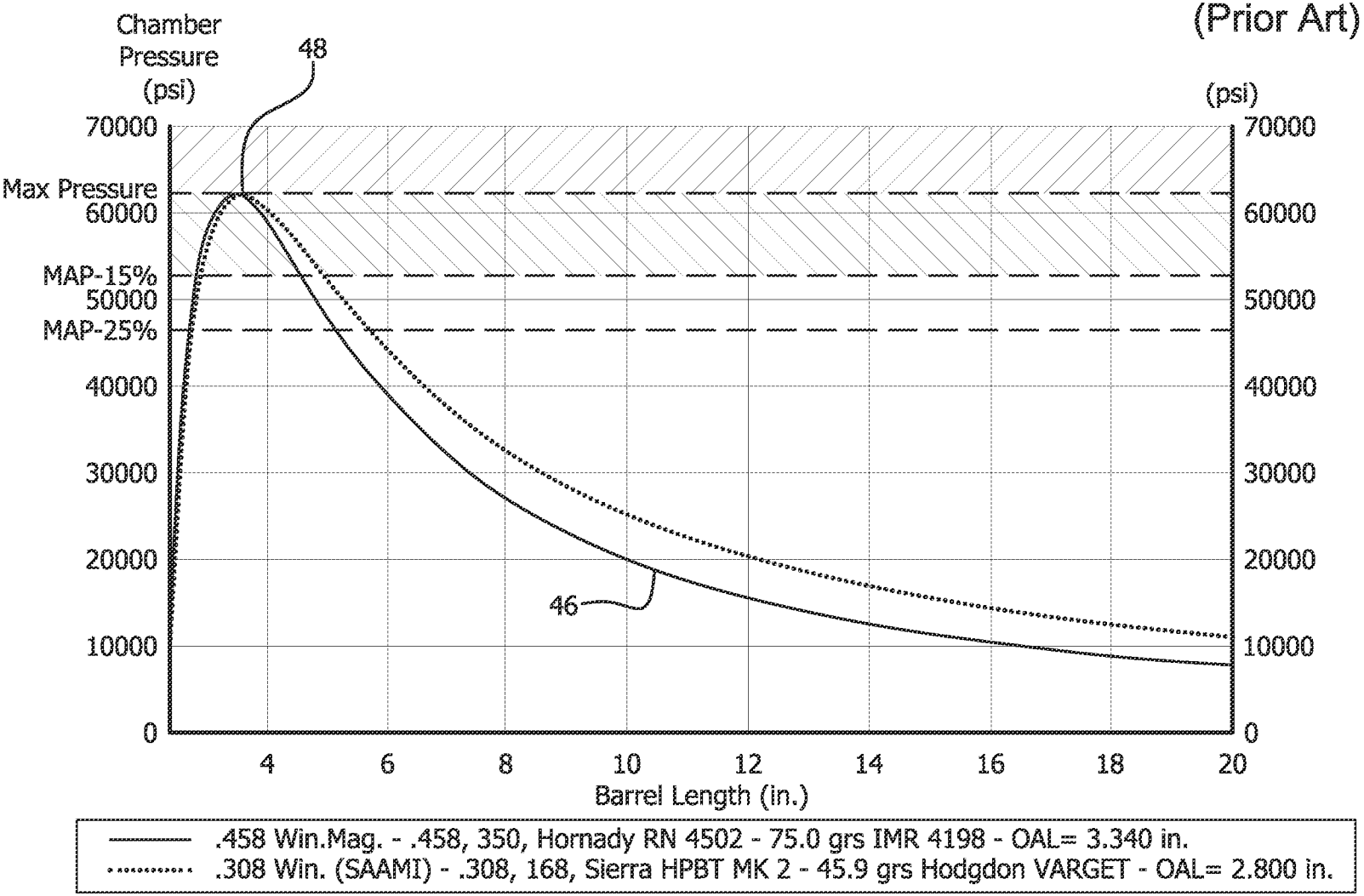
FIG. 7 (Prior Art)
FIG. 7 is a graph showing pressure with respect to time for a prior art propellant.

FIG. 7 shows a typical pressure curve 46 for a typical smokeless firearm powder. The pressure curve 46 rises quickly to a peak 48 near the beginning of the ignition process, and then gradually drops as the bullet is pushed down the barrel. The pressure at the peak 46 must not exceed the maximum safe pressure of the firearm and cartridge casing 40, resulting in lower pressures throughout the remainder of the pressure curve 46.

Figure 8:
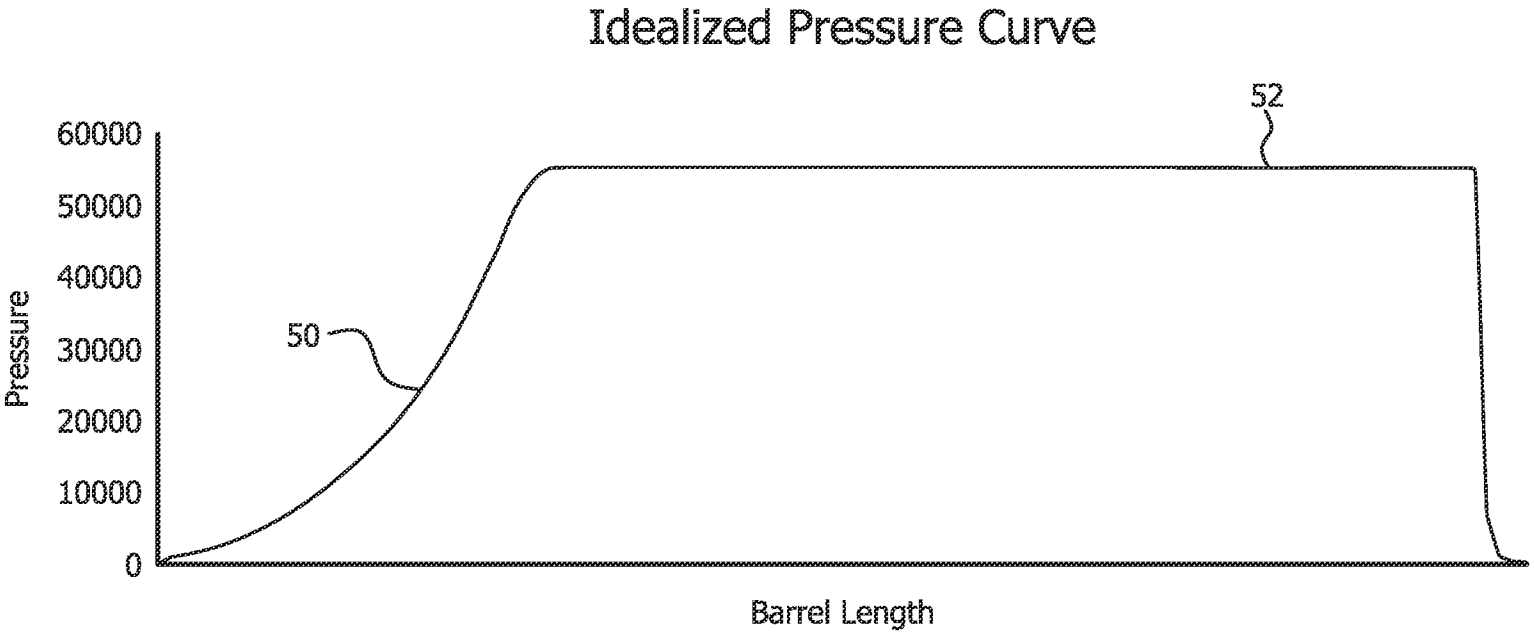
FIG. 8 is a graph showing pressure with respect to time for a propellant sheet of FIG. 5.

FIG. 8 shows a pressure curve 50 that is achievable with the propellant 10. The size and shape of the triangles 20 can be predetermined to produce a pressure curve 50 that rises more gradually to a maximum pressure 52, and then maintains that maximum pressure throughout the entire time that the bullet is travelling through the barrel. Maintaining a predetermined pressure level for a longer period of time permits the use of a lower maximum pressure to be used to accelerate the bullet to a higher velocity, while reducing felt recoil and reducing wear and tear on the firearm.

The size and shape of the triangles 20, as well as the amount of surface area covered by thermite 18 as compared to the amount of uncovered surface area, can be predetermined to produce a variety of desired pressure curves 50 for a variety of firearm cartridges as well as for other applications.

Figure 9:
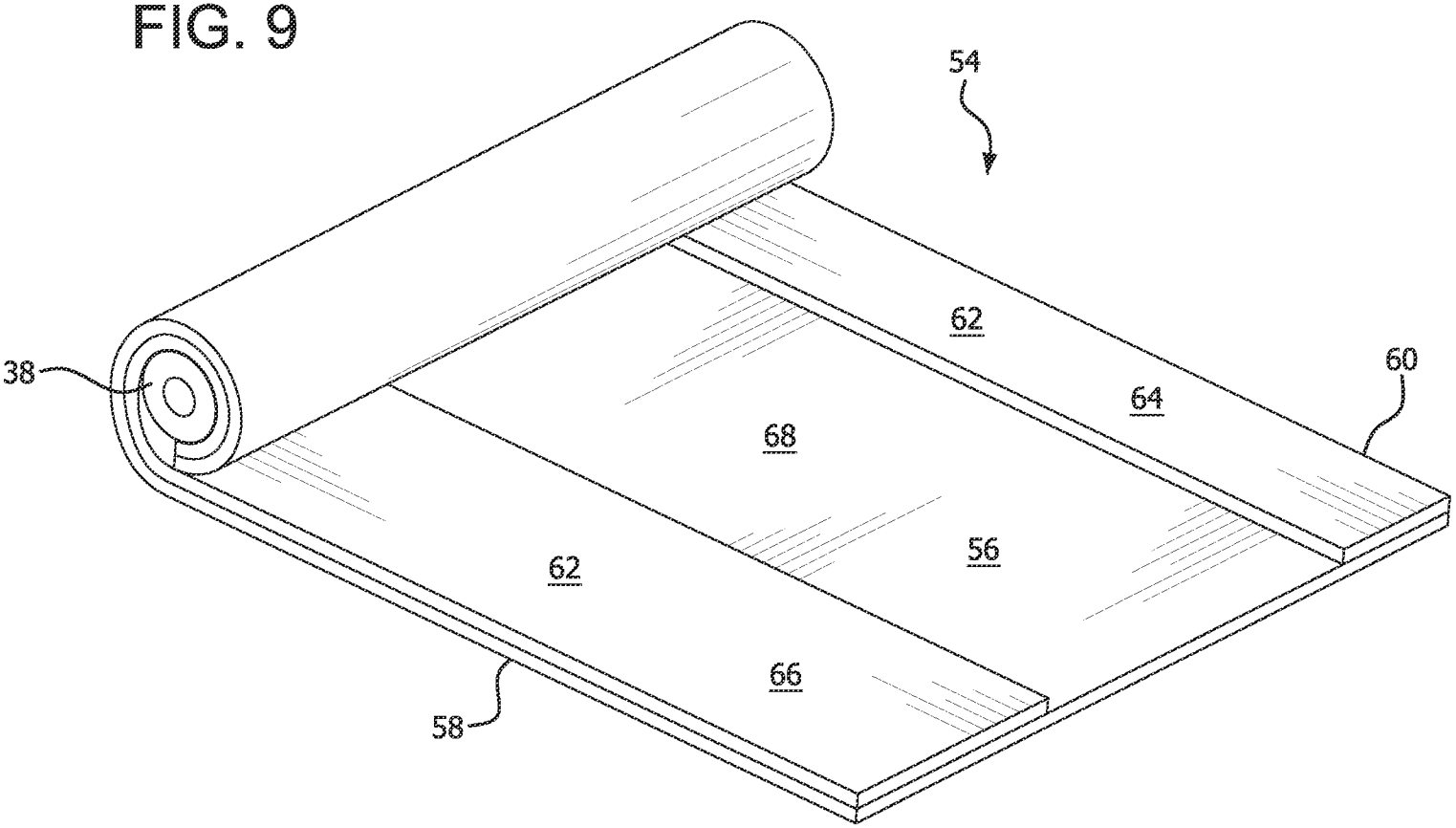
FIG. 9 a perspective view of a propellant sheet of FIG. 1 partially rolled around a nonburnable tube FIG. 10 a perspective view of a propellant sheet partially rolled around a nonburnable tube.

Alternatively, shapes and patterns of thermite 18 or other high burn rate material that differ from triangular may be used without departing from the scope of the invention. FIG. 9 illustrates a propellant 54 having a substrate sheet 56 with a first edge 58 and a second edge 60. In the illustrated example, the sheet 56 is made from nitrocellulose. Thermite 62 has been deposited on the sheet 56 in a first band 64 and a second band 66. The thermite 62 is deposited in a layered structure as shown in FIG. 2 and described above. The sheet 56 is rolled around a nonburnable tube 38 (FIG. 3), which in the illustrated example is brass. When the propellant 54 is inserted into a casing 40, the first edge 58 is inserted first, so that the first edge 58 is closest to the primer pocket 42.

In use, the ignition products from the primer will travel through the tube 38, beginning ignition with the second edge 60 and thermite band 64. The presence of the thermite band 64 is anticipated to rapidly increase the pressure towards the maximum safe pressure. As ignition continues through the uncoated sheet portion 68, the ignition process will not proceed as quickly, resisting increases in pressure above the maximum safe level. As the bullet continues towards the muzzle of the barrel, increasing the available space for ignition products, the ignition will reach the thermite band 66, accelerating the ignition to maintain a pressure level close to the maximum pressure level.

Figure 10:
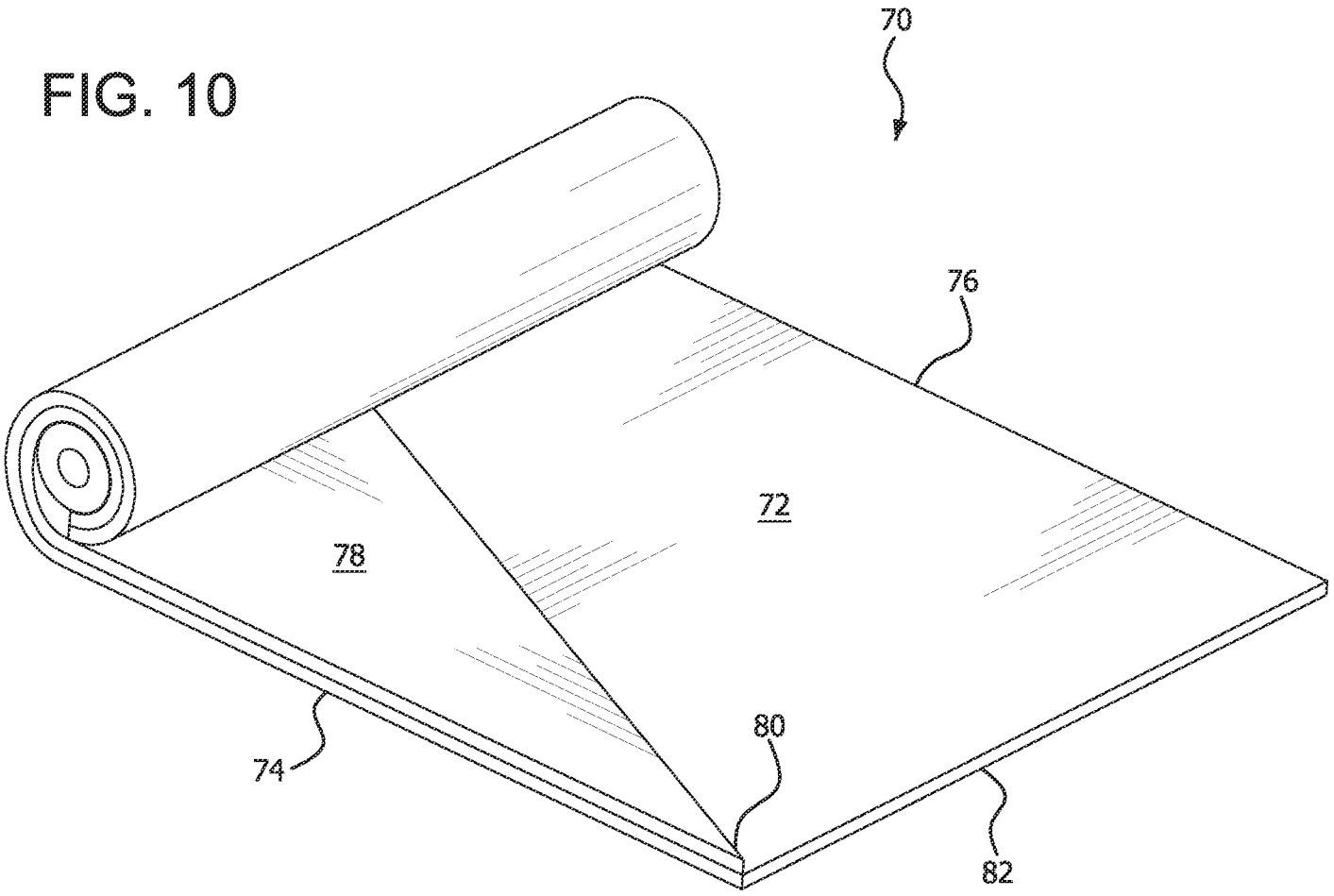
Figure 11:
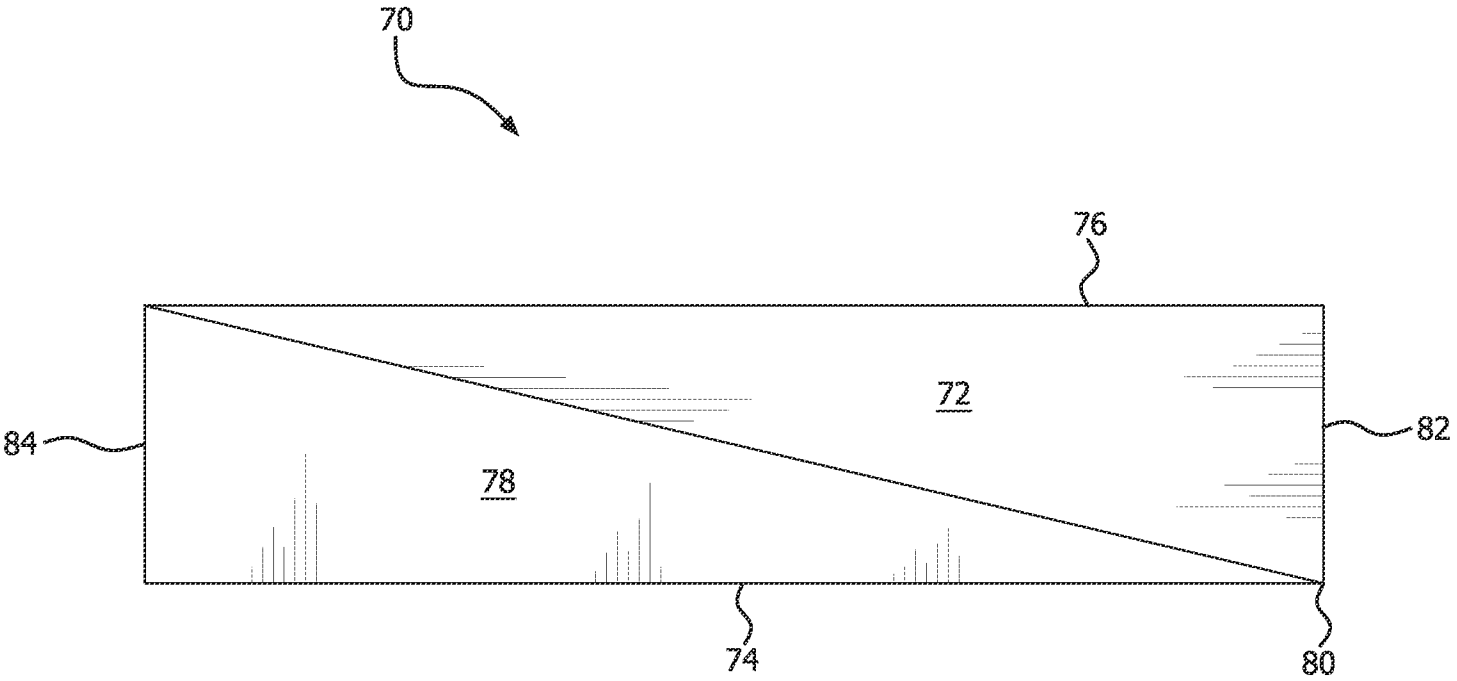
FIG. 11 is a side elevational view of a propellant sheet of FIG. 10, showing the sheet unrolled.

Another alternative propellant 70 is illustrated in FIGS. 10-11. The propellant 70 has a substrate sheet 72 with a first edge 74 and a second edge 76. In the illustrated example, the sheet 72 is made from nitrocellulose, but other substrate sheets may be used in the same manner as for the propellant 10 described above. A material having a high burn rate, for example, thermite 78, has been deposited on the sheet 72 in a large triangle, having an apex 80 adjacent to both the first edge 74 as well as the first end 82. Other high burn rate materials can be used instead of thermite as described above with respect to the polymer 10. The thermite 78 increases in width as the second end 84 of the sheet 72 is approached, with the entire width of the sheet 72 being coated by thermite 78 at the second end 84. The propellant 70 is rolled around a nonburnable tube 38 beginning with the second end 84, so that the greatest amount of thermite 78 is adjacent to the nonburnable tube 38. The propellant 70 is then inserted into a casing 40 with the first edge 74 closest to the primer pocket 42.

In use, ignition products from the primer will flow through the tube 38, beginning ignition at the second edge 76 of the propellant 70. It is also anticipated that ignition will begin at the outside of the rolled propellant sheet 70, progressing not only rearward towards the first edge 74, but also inward towards the tube 38. As ignition progresses rearward and inward, greater proportions of thermite 78 are ignited, increasing the pressure generated as the bullet leaves the barrel. The amount of reaction products is thus increased as the space available for those reaction products increases, thus maintaining a pressure approaching but below a safe maximum pressure.

Figure 12:
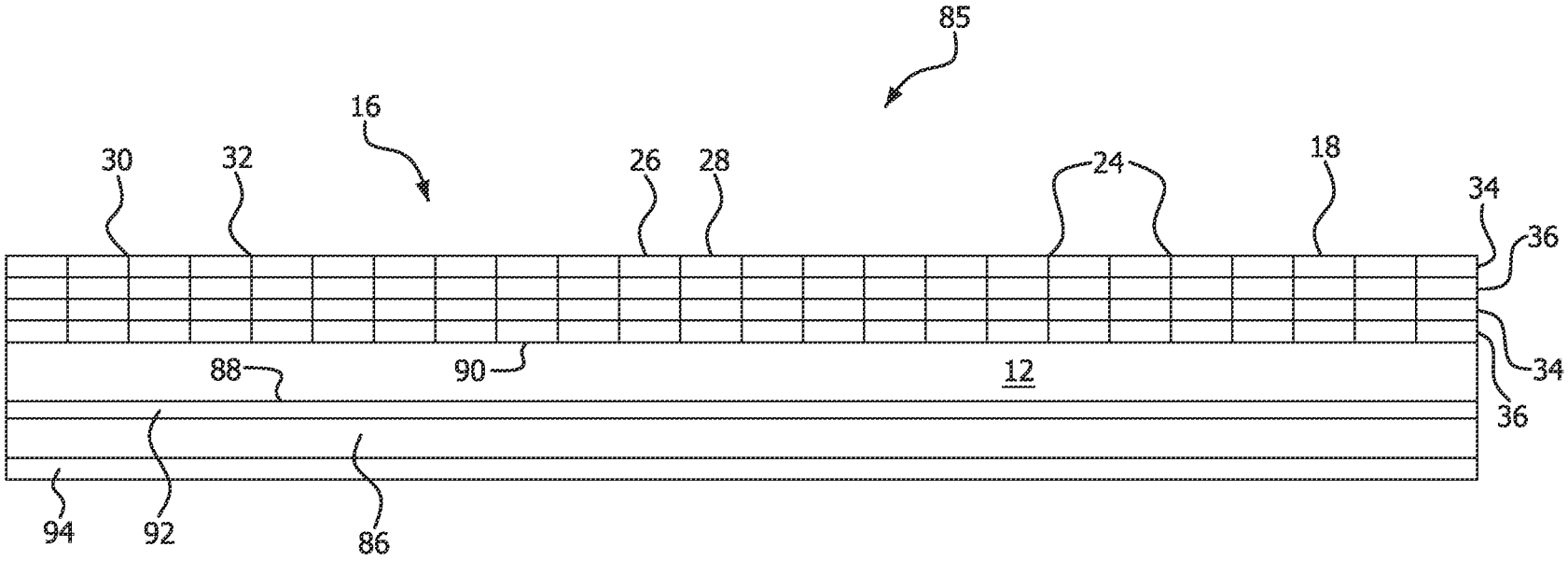
FIG. 12 is a side elevational view of another example of a propellant sheet of FIG. 1, showing the sheet unrolled.

Referring to FIG. 12, any of the propellants described above and illustrated in FIGS. 1-11 may include a boron layer. In FIG. 12, the illustrated example of a propellant 85 includes a boron layer 86 is disposed on the surface 88 opposite the surface 90 upon which the thermite composition 18 or other fast burning material has been deposited. As used herein, a layer (thermite or boron) is described as being disposed on or deposited upon a surface regardless of whether it is deposited directly on that surface, or whether an adhesion layer is present between the boron layer 86 and the surface. In the illustrated example, the boron layer 86 has been deposited upon an adhesion improvement layer 92, which was deposited on the surface 88 of the substrate 12. The illustrated example of an adhesion layer 92 is titanium. A capping or protective layer 94 is deposited over the boron layer 86. In the illustrated example, the capping layer 94 is either aluminum or titanium. Although the illustrated example of the boron layer 86 is a single layer, some examples may include multiple boron layers. Some examples may include boron deposited on the thermite composition 18 or other fast burning material in addition to, or instead of being deposited on the surface 88 of the substrate 12. As another alternative, the boron could be deposited between the substrate 12 and thermite 18. In yet other examples, a titanium layer could be deposited on both sides of the substrate 12 prior to deposition of other layers. Some examples of the boron layer 86 may have a thickness of about 10 nm to about 20 nm. Once the propellant 85 of FIG. 12 is made, it may be used within a firearm cartridge as shown in FIGS. 3-6 and as described above.

The inclusion of the boron layer 92 provides for an additional exothermic reaction which enhances the energy generation of the propellant 10. Because some examples of the substrate 12 in the illustrated example include nitroglycerin, those skilled in the art will recognize that the nitroglycerin undergoes ignition according to the exothermic reaction $4C_3H_3N_3O_{9\rightarrow 6}N_2+12CO+10H_2O+7O_2$. Some of this oxygen will be used to aid in the ignition of the nitrocellulose, which is oxygen deficient. However, some of this oxygen is available for the ignition of boron according to the reaction $4B+3O_{2\rightarrow 2}B_2O_3$. This reaction produces 14,050 cal./g of energy.

Figure 13:
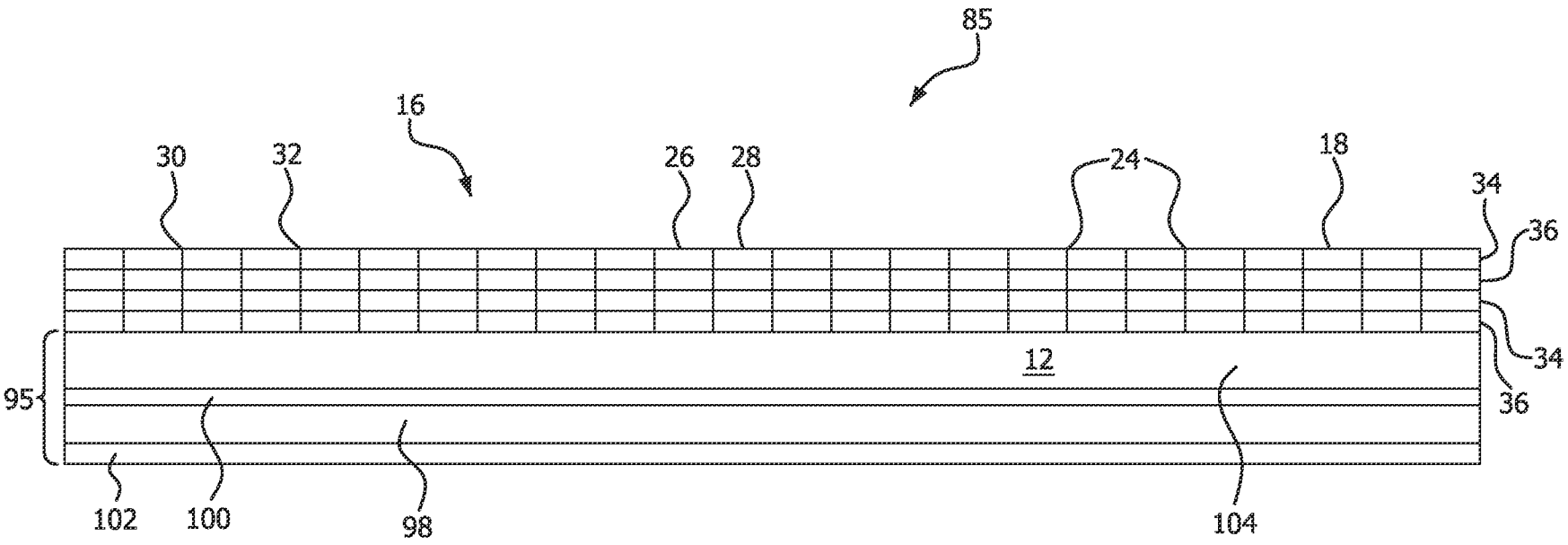
FIG. 13 is a side elevational view of another example of a propellant sheet, showing the sheet unrolled.

FIG. 13 illustrates another example of the propellant 96 includes a substrate sheet 95 having a reactive metal layer 98 that may be boron or magnesium. The layer 98 is disposed between a pair of passivation layers 100, 102 which in the illustrated example are aluminum. A polymer layer 104, which in the illustrated example may be a dielectric polymer, is adjacent to the layer 100. The illustrated example of the thermite composition 18 is deposited above the polymer layer 104. Although all examples of this embodiment will include an aluminum or possibly titanium layer on either side of the layer 98, the polymer layer 104 and thermite composition 18 may be located on either the same side or opposite sides of the layers 98, 100, 102. The propellant 96 may be wrapped around a nonburnable tube and placed within a firearm cartridge casing in the same manner as described above.

The present invention therefore provides a propellant for firearm cartridges and other applications for which the pressure curve can be predetermined by the design of the thermite deposition on the nitrocellulose sheet. Although the primary factor determining burn rate is the shape of the triangles and amount of surface area covered by the thermite, other factors, such as layer thickness and total deposition thickness, can also be used to provide a predetermined burn rate. The propellant can be produced safely and inexpensively, and can be transported with minimized risk. It can be used with a wide variety of handgun, rifle, and shotgun cartridges, as well as for other applications utilizing a propellant. The propellant can also be used within other pressure vessels to produce a desired pressure curve.

A variety of modifications to the above-described embodiments will be apparent to those skilled in the art from this disclosure. Thus, the invention may be embodied in other specific forms without departing from the spirit or essential attributes thereof. The particular embodiments disclosed are meant to be illustrative only and not limiting as to the scope of the invention. The appended claims, rather than to the foregoing specification, should be referenced to indicate the scope of the invention.

What is claimed is:

1. A propellant, comprising a flexible sheet defining a first surface, a first edge, and a second edge, the flexible sheet being burnable or explosive, the flexible sheet having an ignitable material deposited thereon, the imitable material being deposited in a pattern, the pattern defining at least one covered sheet portion upon which ignitable material has been deposited and at least one uncovered sheet portion upon which ignitable material is not present, the covered and uncovered sheet portions being predetermined to provide a changing ignition rate.

2. The propellant according to claim 1, wherein the flexible sheet is made from nitrocellulose.

3. The propellant according to claim 1, wherein the ignitable material includes a metal oxide and a reducing metal.

4. The propellant according to claim 3, wherein the metal oxide and reducing metal are present as alternating layers.

5. The propellant according to claim 4, wherein the metal oxide is cupric oxide, and the reducing metal is magnesium.

6. The propellant according to claim 1:

further comprising a nonbumable tube; and the flexible sheet being rolled around the nonbumable tube.

7. The propellant according to claim 1, wherein the pattern includes at least one triangular covered sheet portion.

8. The propellant according to claim 1, wherein the flexible sheet comprises a polymer layer.

9. The propellant according to claim 8, wherein the flexible sheet further comprises a reactive metal layer disposed between a pair of passivation layers.

10. A propellant, comprising a flexible sheet defining a first surface, a first edge, and a second edge, the flexible sheet having an ignitable material deposited thereon, the ignitable material being deposited in a pattern, the pattern defining at least one covered sheet portion upon which ignitable material has been deposited and at least one uncovered sheet portion upon which ignitable material is not present, the covered and uncovered sheet portions being predetermined to provide a predetermined ignition rate or a predetermined pressure curve within a pressure vessel; wherein the pattern includes a series of triangular covered portions, each covered portion defining a base adjacent to the first edge, and an apex adjacent to the second edge.

11. A propellant, comprising a flexible sheet defining a first surface, a second surface, a first edge, and a second edge, the flexible sheet having an ignitable material deposited on the first surface, the ignitable material being deposited in a pattern, the pattern defining at least one covered sheet portion upon which ignitable material has been deposited and at least one uncovered sheet portion upon which ignitable material is not present, the covered and uncovered sheet portions being predetermined to provide a predetermined ignition rate or a predetermined pressure curve within a pressure vessel; and further comprising boron deposited on the second surface.

12. The propellant according to claim 11, further comprising an adhesion layer deposited between the second surface and the boron.

13. A propellant, comprising:

a flexible sheet defining a first surface, a second surface, a first edge, and a second edge, the flexible sheet having an ignitable material deposited on the first surface, the ignitable material being deposited in a pattern, the pattern defining at least one covered sheet portion upon which ignitable material has been deposited and at least one uncovered sheet portion upon which ignitable material is not present, the covered and uncovered sheet portions being predetermined to provide a predetermined ignition rate or a predetermined pressure curve within a pressure vessel;

boron deposited on the second surface; and a capping layer deposited on the boron.

14. A firearm cartridge, comprising:

a casing, the casing having a side wall, an interior portion within the side wall, an open front end, a back end, a primer pocket defined within the back end, and a flash hole defined between the primer pocket and the interior portion;

a propellant, comprising a flexible sheet defining a first surface, a first edge, and a second edge, the flexible sheet having an ignitable material deposited thereon, the ignitable material being deposited in a pattern, the pattern defining at least one covered sheet portion upon which ignitable material has been deposited and at least one uncovered sheet portion upon which ignitable material is not present, the covered and uncovered sheet portions being predetermined to provide a predetermined ignition rate or a predetermined pressure curve within a pressure vessel;

a nonburnable tube defining a pair of ends and a passageway therebetween;

the flexible sheet being rolled around the nonburnable tube;

the propellant being disposed within the interior portion of the casing, the first edge of the flexible sheet being adjacent to the back end of the casing, the second edge of the flexible sheet being adjacent to the front end of the casing, one end of the nonburnable tube being disposed over the flash hole, with the flash hole being in communication with the passageway.

15. The firearm cartridge according to claim 14, wherein the flexible sheet is made from nitrocellulose.

16. The firearm cartridge according to claim 14, wherein the ignitable material includes a metal oxide and a reducing metal.

17. The firearm cartridge according to claim 16, wherein the metal oxide and reducing metal are present as alternating layers.

18. The firearm cartridge according to claim 17, wherein the metal oxide is cupric oxide, and the reducing metal is magnesium.

19. The firearm cartridge according to claim 14, wherein the pattern includes at least one triangular covered sheet portion.

20. A firearm cartridge comprising:

a casing, the casing having a side wall, an interior portion within the side wall, an open front end, a back end, a primer pocket defined within the back end, and a flash hole defined between the primer pocket and the interior portion;

a propellant, comprising a flexible sheet defining a first surface, a first edge, and a second edge, the flexible sheet having an ignitable material deposited thereon, the ignitable material being deposited in a pattern, the pattern defining at least one covered sheet portion upon which ignitable material has been deposited and at least one uncovered sheet portion upon which ignitable material is not present, the covered and uncovered sheet portions being predetermined to provide a predetermined ignition rate or a predetermined pressure curve within a pressure vessel, wherein the pattern includes a series of triangular covered portions, each covered portion defining a base adjacent to the first edge, and an apex adjacent to the second edge;

a nonbumable tube defining a pair of ends and a passageway therebetween;

the flexible sheet being rolled around the nonburnable tube; and the propellant being disposed within the interior portion of the casing, the first edge of the flexible sheet being adjacent to the back end of the casing, the second edge of the flexible sheet being adjacent to the front end of the casing, one end of the nonburnable tube being disposed over the flash hole, with the flash hole being in communication with the passageway.

21. A firearm cartridge, comprising:

a casing, the casing having a side wall, an interior portion within the side wall, an open front end, a back end, a primer pocket defined within the back end, and a flash hole defined between the primer pocket and the interior portion;

a propellant, comprising a flexible sheet defining a first surface, a second surface, a first edge, and a second edge, the flexible sheet having an ignitable material deposited on the first surface, the ignitable material being deposited in a pattern, the pattern defining at least one covered sheet portion upon which ignitable material has been deposited and at least one uncovered sheet portion upon which ignitable material is not present, the covered and uncovered sheet portions being predetermined to provide a predetermined ignition rate or a predetermined pressure curve within a pressure vessel;

a nonburnable tube defining a pair of ends and a passageway therebetween;

the flexible sheet being rolled around the nonburnable tube;

the propellant being disposed within the interior portion of the casing, the first edge of the flexible sheet being adjacent to the back end of the casing, the second edge of the flexible sheet being adjacent to the front end of the casing, one end of the nonburnable tube being disposed over the flash hole, with the flash hole being in communication with the passageway; and further comprising boron deposited on the second surface.

22. The firearm cartridge to claim 21, further comprising an adhesion layer deposited between the second surface and the boron.

23. The firearm cartridge according to claim 21, further comprising a capping layer deposited on the boron.

24. A firearm cartridge, comprising:

a casing, the casing having a side wall, an interior portion within the side wall, an open front end, a back end, a primer pocket defined within the back end, and a flash hole defined between the primer pocket and the interior portion;

a propellant, comprising a flexible sheet defining a first surface, a first edge, and a second edge, the flexible sheet having an ignitable material deposited thereon, the ignitable material being deposited in a pattern, the pattern defining at least one covered sheet portion upon which ignitable material has been deposited and at least one uncovered sheet portion upon which ignitable material is not present, the covered and uncovered sheet portions being predetermined to provide a predetermined ignition rate or a predetermined pressure curve within a pressure vessel, the flexible sheet comprising a polymer layer;

a nonburnable tube defining a pair of ends and a passageway therebetween;

the flexible sheet being roiled around the nonburnable tube;

the propellant being disposed within the interior portion of the casing, the first edge of the flexible sheet being adjacent to the back end of the casing, the second edge of the flexible sheet being adjacent to the front end of the casing, one end of the nonburnable tube being disposed over the flash hole, with the flash hole being in communication with the passageway.

25. The firearm cartridge according to claim 24, wherein the flexible sheet further comprises a reactive metal layer disposed between a pair of passivation layers.

* * * * *